United States Patent [19]

Katabuchi et al.

[11] 4,126,419

[45] Nov. 21, 1978

[54] COMBUSTION DEVICE FOR BURNING WASTE GASES CONTAINING COMBUSTIBLE AND NOXIOUS MATTERS

[76] Inventors: Keichi Katabuchi, No. 13-13, 4-chome, Heiwadai, Nerima-ku, Tokyo; Fujio Kawana, c/o Someya-SO No. 3-13, 3-chome, Tokiwadaira, Matsudo-shi, Chiba; Hajime Arai, No. 446, Yatsugasaki, Matsudo-shi, Chiba, all of Japan

[21] Appl. No.: 856,166

[22] Filed: Nov. 30, 1977

Related U.S. Application Data

[63] Continuation of Ser. No. 719,447, Sep. 1, 1976, which is a continuation of Ser. No. 562,115, Mar. 26, 1975, abandoned.

[30] Foreign Application Priority Data

Apr. 2, 1974 [JP] Japan ..... 49/37114

[51] Int. Cl.[2] ..... F23G 7/06

[52] U.S. Cl. ..... 422/109; 110/210; 431/5; 165/4; 165/5; 423/212; 137/309; 137/311; 422/177

[58] Field of Search ..... 23/277 C, 277 R, 284, 23/288 E, 288 FB; 110/8 R, 8 A; 431/5; 261/DIG. 9, 17; 432/59, 212; 165/4, 5; 423/212; 137/309, 311

[56] References Cited

U.S. PATENT DOCUMENTS

| | | | |
|---|---|---|---|
| 3,088,271 | 5/1963 | Smith | 23/277 C |
| 3,224,842 | 12/1965 | Manske | 23/277 C |
| 3,718,440 | 2/1973 | Foster-Pegg | 23/277 C |
| 3,870,474 | 3/1975 | Houston | 23/277 C |
| 3,881,874 | 5/1975 | Shular et al. | 23/277 C |

*Primary Examiner*—James H. Tayman, Jr.
*Attorney, Agent, or Firm*—Holman & Stern

[57] ABSTRACT

A combustion device comprising a plurality of regenerative units formed by a plurality of separate radially extending compartments each containing a plurality of corrugated highly conductive metal plates compressed together with the corrugations in the adjacent plates intersecting each other at right angles so as to provide meandering passages for the gases between the adjacent corrugated plates; a rotary switching valve provided at one end of said regenerative means for controlling the flow of said waste gases flowing therethrough; a reaction zone provided at the other end of said regenerative means in which said waste gases are reacted; and a temperature-adjusting chamber located within said reaction zone and provided with an auxiliary combustion burner and an excess-heat disposal branch conduit.

8 Claims, 5 Drawing Figures

COMBUSTION DEVICE FOR BURNING WASTE GASES CONTAINING COMBUSTIBLE AND NOXIOUS MATTERS

This is a continuation of application Ser. No. 719,447, filed Sept. 1, 1976 which in turn is a continuation of application Ser. No. 562,115 filed Mar. 26, 1975 which is now abandoned.

BACKGROUND OF THE INVENTION

This invention relates to a contact-type waste gas combustion device for burning waste gases containing combustible and noxious matters generated in various processes such as photogravure printing, coating, laminating, enamel coating on electric wires, general painting and the like by increasing the temperature of such gases through a heat exchange with regenerative means to a temperature above the ignition temperature of such gases and then surface-burning the gases over and/or within the regenerative means by the use of heat derived from the regenerative menas or contact means as the combustion meduim.

Thinner-vapor from a painting shop, printing ink solvent vapor from a printing shop, solvent-vapor from a laundry shop and waste gases from a petroleum chemical shop are, for example, generally discharged into the atmosphere while the gases still contain unburnt or incompletely burnt combustible materials which tend to pollute the environment if discharged into the atmosphere. However, since these combustible matters are generally contained in a charge of waste gases in very small amounts below several thousands ppm, for example, even if one tried to burn waste gases containing such combustible matters in low concentrations, they will not ignite or flames will not spread in the gases. Thus, the so-called catalyst method, in which waste gases are burnt on the surface of a catalyst or an active substance, has been considered an excellent method.

Although the catalyst method has the advantage that the combustion of waste gases can be carried out at a relatively low temperature, such a method requires the use of an expensive catalyst as well as a relatively large installation. In order to carry out the waste gas combustion continuously, it is generally necessary to burn a combustion support fuel throughout the combustion operation. Furthermore, even if efforts are exerted to maintain the thickness of the catalyst layer uniform throughout the combustion operation, since the catalyst generally is relatively thin, the catalyst layer thickness becomes non-uniform resulting in irregular flow of gases through the catalyst. As a result, a local overheating (hot spots) occurs in the catalyst layer to thereby accelerate the deterioration of the expensive catalyst layer and the catalyst has to be prematurely replaced by a new catalyst layer In order to prevent occurrence of any local overheating on the catalyst layer, if the thickness of the catalyst layer is increased to an allowable upper limit, the catalyst method still has the disadvantage that gases containing unburnt or partially burnt portions may be discharge into the atmosphere. Combustion conditions for waste gases having varying combustible matter concentrations also vary sensitively because the employed catalyst in the catalyst method has a high activity. Furthermore, the waste gases from the above-mentioned various industrial fields are becoming more complicated year after year and the quantity of combustible matters contained in such industrial waste gases also varies within a wide range. Such being the situation, from the view point of operation conditions, the catalyst method also has the disadvantage that the available temperature range is relatively limited and narrow for the combustion device employed in the catalyst method.

Another of the prior art waste gas combustion methods is the so-called direct combustion method. The direct combustion method has some advantages as compared with the catalyst method in that the direct combustion method requires a relatively smaller installation than that required in catalyst method particularly because the method requires no devices or means necessary in addition with the employment of a catalyst. In the direct combustion method, in order to directly burn waste gases with flames, fuel has to be continuously supplied to maintain the flames at a high temperature to sustain the combustion of the gases, this resulting in increase of fuel cost. Also, in the direct combustion method, a minor portion of waste gases pass through the combustion system in an unheated state and as the result, unburnt material and/or partial oxides are inevitably discharged out into the atmosphere from the system. The thus discharge oxides contain formaline and the like, for example and emit an odor much less desirable and more objectionable than the charge of waste gases or the gases prior to the combustion. In a strict sense, the generation of such unburnt material and/or partial oxides presents a grave problem. This problem is equally common to the catalyst method though the seriousness of the problem may be different from that in connection with the direct combustion method.

Considered from the structural aspect, according to the catalyst method, a charge of waste gases generally flows from a heat exchanger to and into a heating zone where the temperature of the gases is increased to a predetermined value and then burnt over the catalyst layer; the increased temperature gases finally flow back to the heat exchanger to pass through the exchanger from where the gases are discharged out of the system. On the other hand, according to the direct combustion method, a charge of waste gases flows from the heat exchanger directly into a combustion zone where the gases contact flames from a gas burner or the like to be burnt thereby and then flow back through the heat exchanger from where the gases are discharged out of the system.

In a reactor which has a heat exchanger and in which a reaction temperature is maintained with the reaction heat from the reactor itself, the temperature of a catalyst or more particularly, the reaction temperature at the inlet of the catalyst is generally maintained by directly forcing a charge of waste gases at a cold temperature to flow into the inlet of the catalyst prior to the flowing of the gases into the heat exchanger.

When this method is carried out in a heat exchanger having a group of regenerative units, the average temperature of waste gases to be discharged out of the system in the discharge stroke is high enough to deteriously affect the rotary switching valve.

SUMMARY OF THE INVENTION

A primary object of the present invention is to provide a novel and improved contact-type waste gas combustion device which can effectively eliminate the disadvantages inherent in the prior art referred to above.

Another object of the present invention is to provide a novel and improved method for disposing of any excess heat generated in the contact-type waste gas combustion device.

According to the present invention, waste gases maintained at a predetermined highest temperature after a substantial portion of the gases has completed reaction is discharged out of the system and the high temperature waste gases then flow through the group of regenerative units to thereby reduce the amount of waste gases necessary to heat the regenerative units so as to minimize the quantity of heat necessary for heating air in the air intake stroke whereby the temperature at the catalyst inlet or of the temperature adjusting chamber can be maintained constant. To describe more in detail, any excess heat is passed through an excess heat disposal branch discharge conduit to be discharged, maintaining its temperature at a reduced value. In order to maintain the temperature within a temperature adjusting chamber at 750° C, when it is assumed that the rotation rate of a rotary switching valve is 4 r.p.m., the time period of the air intake stroke is set to about 7.6 seconds, while that of the discharge stroke is set to about 7.5 seconds, respectively, totalling to about 15 seconds. In the discharge stroke, the regenerative units are heated to a temperature below 750° C, for example, to 730° C, by the waste gases flowing from the the temperature adjusting chamber and thus, the thickness of each of the regenerative units, which is to be heated to 730° C in 7.5 seconds, is of itself determined. This corresponds to one-half rotation of the rotary switching valve or the air intake stroke, for example. Thus, when a charge of cold waste gases is introduced into the combustion device, the waste gases come to contact the regenerative units maintained at 730° C to be heated to about 710° C, thereby, whereupon the combustible matters contained in the charge of waste gases (solvent and the like) are burnt. After the combustion, the temperature of the waste gases rise, reaching about 800° C, for example, though the temperature may vary depending upon the type and quantity of the solvent burned and the increased temperature waste gases flow to and into the temperature adjusting chamber. However, the temperature holding capacity of the regenerative units is limited and the regenerative units can maintain the temperature of 730° C for only about 5 seconds out of the 7.5 seconds in the air intake stroke, for example. Therefore, the regenerative units are at a lower temperature (80° C, for example) for the remaining period of 2.5 seconds of the air intake stroke. In other words, the waste gases flow to and into the temperature adjusting chamber at 80° C and thus the temperature within the temperature adjusting chamber will be defined as follows:

$$\frac{800^\circ\ C \times 5\ \text{seconds} + 80^\circ\ C \times 2.5\ \text{seconds}}{7.5\ \text{seconds}}$$

and if the temperature-within the temperature adjusting chamber is higher than 750° C, since the temperature within the temperature adjusting chamber increases gradually, an adjustable waste gas control valve opens wider to thereby increase the discharge amount of waste gases at high temperature. On the other hand, if the temperature within the temperature-adjusting chamber is lower than 750° C, since the temperature within the temperature adjusting chamber will decrease gradually, the branch discharge, gas control valve reduces its opening gradually to thereby decrease the discharge of high temperature gases. In this way, the area of the regenerative units of the combustion device of the invention is first heated at the inlet end of the regenerative units during the initial stage of a discharge stroke. Therefore, when the rotation rate of the rotary switching valve is suitably selected, the ultimate highest temperature of the regenerative units, that is, 750° C, is of itself limited and the distal ends of the regenerative units will never reach the ultimate highest temperature and thus, the waste gases will not be discharged out of the system at high temperature.

In the contact-type combustion device for waste gases, according to the present invention, since the heat exchanger in the form of regenerative means includes a plurality of metal regenerative units, the overall size of the combustion device can be considerably reduced as compared with conventional combustion devices having the same capacity, and in addition, since waste gases deprive the regenerative means of heat and burn as the gases are passing in contact with the regenerative means, no specific means solely designed to burn the waste gases is required. Although the activity of the metal regenerative means is not substantially high since the regenerative means is formed of stainless steel, no separate catalyst is employed. As the result, fuel is only necessary at the start of the operation of the combustion device to thereby reduce fuel cost. In addition, the waste gases can be substantially, completely burnt in the combustion device without generating partial oxides. Furthermore, any variation in operation factors which may occur during the operation on the combustion device can be compensated for and the combustion device has a relatively wide range of available tolerance. Finally, the combustion device is small in size and less expensive and reliable in operation.

The above and other objects and attendant advantages of the present invention will be more readily apparent to those skilled in the art from a consideration of the following detailed description in conjunction with the accompanying drawings which show one preferred embodiment of the invention only for purposes of illustration and not for limitation of the scope of the invention.

PREFERRED EMBODIMENT OF THE INVENTION

Figure 1:
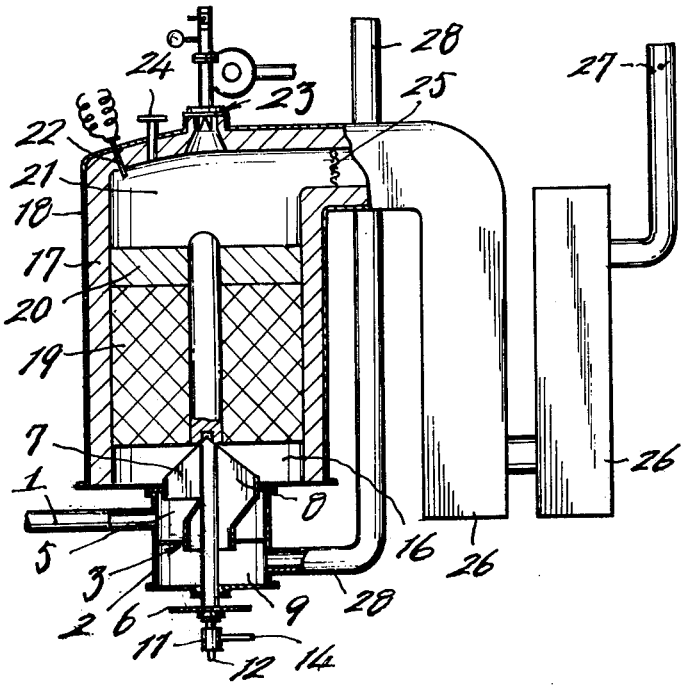
FIG. 1 is an elevational view in partial section of one preferred embodiment of contact-type combustion device for burning waste gases containing combustible and noxious matters constructed in accordance with the present invention.
Figure 4:
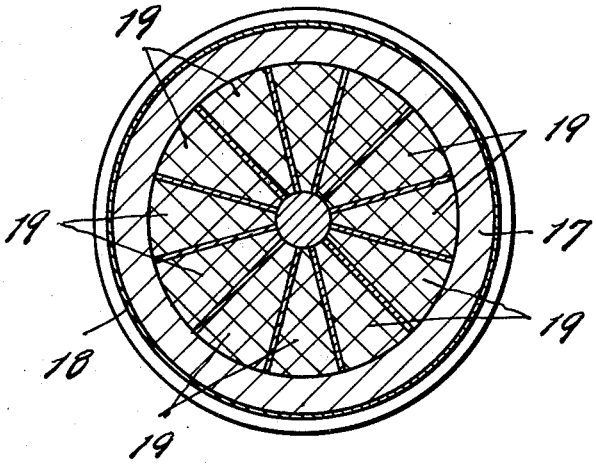
FIG. 4 is a horizontal section taken substantially along line X — X of FIG. 2.

The present invention will be described in relation to the accompanying drawings in which one preferred embodiment of a contact-type combustion device for burning waste gases containing combustible and noxious matters is illustrated. In the illustrated embodiment, a charge of waste gases containing combustible and noxious matters is admitted into an inlet duct 1 in the lower portion of the device; the inflowing waste gases pass through a passage 5 and 7 in a continuously rotating switching valve 3 housed in a valve casing 2; and then into a combustor sheath 18 which is positioned above the valve casing 2 and in which the left-hand portion of metal regenerative means 19 is fixedly mounted. The passage 5 when positioned below the left-hand portion of the regenerative means 19, causes the gases flow in the switch 3 as the valve rotates. In the combustor sheath 18, the waste gases flowing into deprive the regenerative means 19 are subject to the heat stored in the left-hand portion of the regenerative means (with respect) and the gases, temperature is the center line of the means as seen in FIG. 1 rapidly increased to an ignition temperature, or a higher, to thereby effect contact combustion of the gases. The burnt waste gases then flow into a reaction chamber or zone 21 which is located above the regenerative means 9 and in which a temperature adjusting chamber 21 is provided and then the gases pass through the right-hand portion of the regenerative means 19 (with respect to the center line of means 19) which is maintained at a temperature lower than that of the left-hand portion while passing the heat-of-combustion to the metal regenerative means 19 to thereby reduce the temperature of the gases to a constant temperature which is about 5° - 10° C higher than that of the initial charge of waste gases containing combustible and noxious ingredients. The spent waste gases then pass through a passge 8 in the rotary switching valve 3 which is then in position below the right-hand portion of the regenerative means 19 as the valve rotates and discharge into a discharge duct 28 from which the gases are discharged out of the system. The above-mentioned flow movement of the waste gases is repeated to effect continuous operation of the combustion device.

When the charge of waste gases contain a great amount of combustible matters, the gases generate on excessively great quantity of heat and, the temperature of the whole or a portion or portions of the combustor frequently tends to rise to an exceedingly high value. In such a case, a portion of the inflowing waste gases is separated from the rest of the gases which will pass through the right-hand portion of the regenerative means 19 and the separated gas passed directly from the reaction chamber 21 into an excess heat disposal means 26 in the form of a water-cooled pipe where the temperature of a portion of the gas is reduced to and maintained at a suitable temperature. More particularly, the separated gas portion is passed from the temperature adjusting chamber 21 through a contact combustion metal screen 25 which serves to prevent incomplete combustion of waste gases into the excess heat disposal means 26 where the temperature of the gas portion is reduced to a suitable temperature and thereafter, the temperature-reduced gas portion is passed to and into a second discharge conduit in which a temperature control damper 27 is provided and from which the dampered gas portion is discharged. The damper 27 is normally held in its closed position and opened in the manner as will be described hereinafter.

At the start of operation of the combustion device, it is necessary to heat the metal regenerative means 19 to a temperature above the ignition temperature of the combustible inflowing charge of waste gases. For this purpose, a preheater 23, having a burner, is provided in the reaction zone which serves to preheat the regenerative means 19 at the start of operation or supplement heat at the time of the resumption of operation after a down-time or when the charge of waste gases contains an insufficient amount of combustibles. The preheater 23 uses conventional fuel, such as city gas, propane or kerosene. In preheating the metal regenerative means 19, the burner of the preheater 23 is first ignited to heat the temperature adjusting chamber 21 and at the same time, air is admitted into the temperature adjusting chamber 21 via the inlet duct 1; the generated radiant heat heats the right-hand portion of the metal regenerative means 19 as seen in FIG. 1 to a temperature suitable for combustion whereupon a charge of waste gases is admitted into the reaction zone through the inlet duct 1 and regenerative means at the right-hand portion and contact combustion starts. When it is desired to resume the contact combustion operation after a down-time, if the temperature of the metal regenerative element has decreased to a value below the lower limit for ignition temperature or the waste gases contain any insufficient amount of combustible material, the burner 23 is ignited to supplement heat and to thereby ensure a continuous contact combustion operation.

Figure 2:
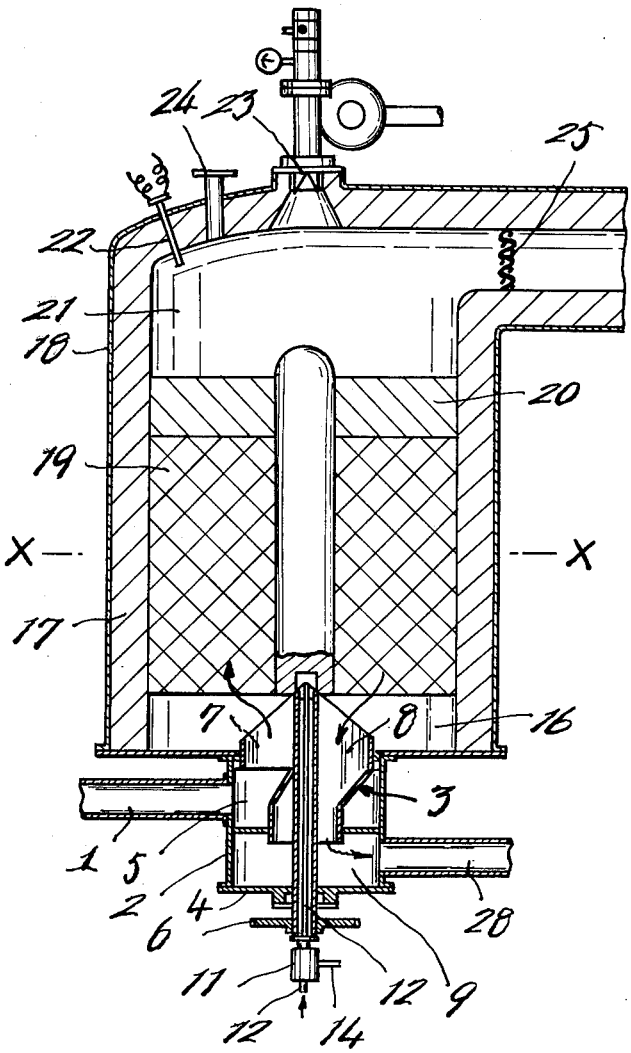
FIG. 2 is an enlarged fragmentary vertically sectional view of a portion of the device of FIG. 1.

The combustor, which constitutes one of the most important components of the contact-type combustion device of the present invention, will be now in detail described referring to FIG. 2; a charge of waste gases containing combustible matters is admitted into the device at the inlet duct 1 and then passes through the passage 5, 7 of the rotary switching valve 3 which is then positioned below the left-hand portion of the regenerative means 19 thus moving into a guide chamber 16 provided at the inlet or lower portion of the combustor outer shell 18 which is lined with an adiabatic material 17. The guide chamber is radially divided into 12 sector-shaped compartments of uniform capacity by means of radially extending partition plates which also extend upwardly to the upper surface of the metal regenerative means 19. Therefore, the upper surface of the metal regenerative means 19 and partition plates lie in the same plane. The metal regenerative means 19 comprises a plurality of regenerative units separated from each other by the partition plates and each regenerative unit includes a plurality of vertically extending corrugated metal plates compressed together in respectively associated compartments defined by the partition plates and arranged with the corrugations in the plates extending at an angle with respect to the vertical and the corrugations in the adjacent plates intersecting with each other at right angles to thereby define meandering passages for the waste gases therebetween.

The corrugated plates should be formed of a material which can stand severe conditions such as a quick high-to-low temperature cycle and vice versa and have the corrugation height of about 4 mm and the thickness of about 0.3 mm. Thus, the corrugated plates are formed of stainless steel which has a high thermal conductivity, activity and heat resistance.

After having passed through the rotary switching valve 3, the charge of waste gas flows upwardly through the meandering passages defined by the corrugations of the adjacent corrugated plates in contact with the plates. As the gases flow along the corrugated plates, the gases are imparted thereto swirling movement and are stirred and mixed by the meandering passages. The thus stirred gases form a turbulent flow in contact with the heat of the plates to receive the plates and reach ignition temperature when the gases pass from the metal regenerative means 19.

Thereafter, the gases flow through a chamotte filtering system refractory layer 20 disposed over the metal regenerative means 19 while continuing to combustion into the temperature adjusting chamber 21 in which a temperature detection (sensing) means 22, the preheater 23 and a peep window 24 are provided for performing their respective functions, as is well known in the art. The temperature detection means 22 is electrically connected to the damper 27 and when the detection means detects any excessively high temperature, the detection means opens the damper 27 in a conventional manner.

Although the chamotte (filter) system refractory layer 20 has a relatively low thermal conductivity on one hand, but on the other hand, such a layer has a relatively high heat preservation capacity. Thus, the gases can more efficiently burn in the combustor. The burnt gases continue to flow through the chamber 21 to and into the right-hand portion of the chamotte system refractory layer 20 maintained at a relatively low temperature. After having passed the lower temperature portion of the refractory layer, the gases then flow along the meandering passages defined by the corrugated plates of the regenerative means 19 in a whirling turbulent flow while giving their heat to the plates. The reduced temperature gases then flow back to and into the guide chamber 16 and thereafter, pass through the passage in rotary switching valve 3 which is then positioned below the right-hand portion of the regenerative means into the exhaust duct 28 from where the gases are discharged out of the system. By repeating the above-mentioned cycle, a continuous contact combustion is assured. In this way, the combustor in the contact combustion device of the invention has a unique feature that the sole combustor has in combination the functions of a heat exchanger, a combustion means and a catalyst.

In the combustor, the rotary switching valve 3 has other functions in addition of the inflowing and discharging of a charge of waste gases. The metal regenerative means 19 is fixedly mounted within the outer shell 18 and the 12 compartments separated by the partition plates are independent chambers. A continuous combution operation is made possible by giving 12 different operation conditions to the 12 independent compartments, respectively, in succession like the frames of a motion picture film.

In addition to the gas inflowing and discharging functions referred to above, the rotary switching valve 3 also has the function to control the independent compartments. The rotary switching valve can also adjust the capacity of the metal regenerative means 19 depending upon the rate of rotation of the valve per unit time. That is, the rotational rate per unit time is increased two-fold; the effective length of the metal regenerative means 19 may be reduced to one half which means that the capacity of the regenerative means is increased two fold as compared with the conventional, corresponding combustors.

The rotary switching valve 3 will be described in detail referring to FIG. 3, after having been introduced into the combustion device at the inlet duct 1, the inflowing charge of waste gases enters the inlet chamber 5 in the valve 3. The waste gases then flow through an inflow distribution chamber 7 in the rotary switching valve, which valve is integral with a shaft which is driven by a rotary valve drive gear 6, and into the guide chamber 16. The rotational rate of the rotary switching valve 3 can be varied within the range of 0.5 – 2 R. P. M. The burnt waste gases entering the guide chamber 16 then flow through the left-hand portion of the regenerative means 19, the reaction chamber, the right-hand portion of the refractory layer 20, the right-hand portion of the regenerative means and the guide chamber into an outflow distribution chamber 8 formed in the switching valve 3. From the outflow distribution chamber 8, the gases flow through an exhaust chamber 9 in the valve 3 into the exhaust duct 28 from where the gases are discharged out of the system.

Figure 3:
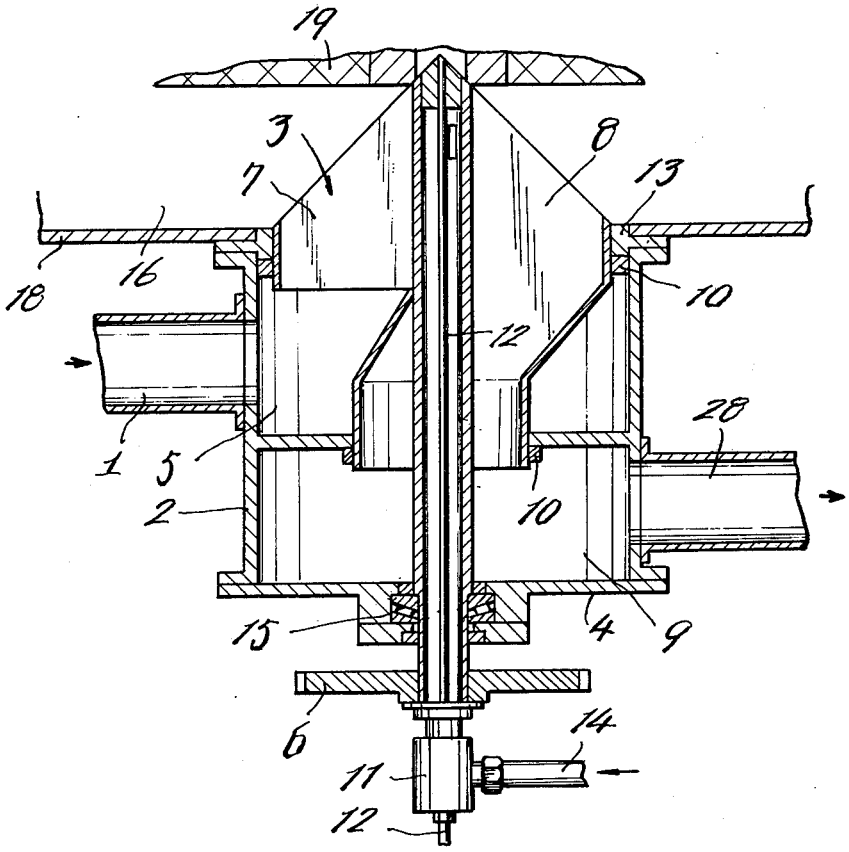
FIG. 3 is a further enlarged vertically sectional view of the lower portion of the device of FIG. 1.
Figure 5:
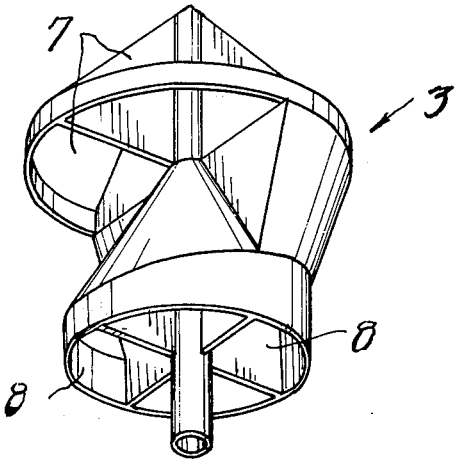
FIG. 5 is a perspective view of the rotary switching valve of the combustion device.

It is necessary to prevent any unburnt gas portion from mixing into the more completely burnt gas portion and for this purpose, the three contact points of the rotary switching valve 3 with the outer shell 2 are sealed at 10; see FIG. 3. The valve 3 is smoothly rotated by supplying oil at the top of the valve from an oil supply source (not shown) through a supply pipe 12 and a swivel joint 11. Secured to the combustor outer shell 18 by means of a rotary switching valve adjusting ring 13 are the rotary switching valve outer shell 2 and rotary switching valve shell cover 4 for supporting the weight of the valve 3.

A slit (not shown) is provided in the upper portion of the hollow shaft of the valve 3 to be communicated with the exhaust distribution chamber 8 of the rotary switching valve 3 when the slit is positioned in the right side as seen in FIG. 3 and air pumped from an external air supply source (not shown) through a purge air conduit 14 and the swivel joint 11 is discharge through the slit. The purge air is pumped to expell any unburnt gas portion remaining in various parts on the gas supply side when the compartments have turned to the gas discharge side. A trace of unburnt gases is allowed to mingle into the perfectly burnt gas portion.

In the foregoing description there is disclosed one preferred embodiment of the invention; it will be readily understood by those skilled in the art that the preferred embodiment is illustrative in nature, and does not limit the scope of the invention in any way. The scope of the invention is only limited by the appended claims.

What is claimed is:

1. A combustion system for burning combustible and noxious waste gases comprising:

a housing having two ends and a longitudinal axis;

inlet means at one end of said housing;

outlet means at the same end of said housing as said inlet means partition means in said housing for longitudinally dividing said housing into a plurality of compartments;

a temperature adjusting chamber at the opposite end of said housing from said inlet and outlet means;

a plurality of fixed, highly thermally conductive metal regenerative means positioned in said plurality of compartments, the waste gases burning in said regenerative means, said regenerative means each comprising a plurality of longitudinally with respect to said axis extending corrugated stainless steel plates, said corrugations being arranged with the corrugations of adjacent plates intersecting at right angles with each other defining meandering passages for the flow of waste gases therebetween, said corrugations extending at an angle greater than zero with respect to said axis;

temperature sensing means in said chamber;

auxiliary burner means located in said chamber for adding heat only when the quantity of heat is insufficient for efficient combustion of said waste gases, said auxiliary burner means being operatively associated with said temperature sensing means;

means for discharging combusting gases from said chamber when the temperature in said chamber exceeds a predetermined maximum, said means for discharging being operatively associated with said temperature sensing means;

rotary valve means in said housing operatively connecting said inlet and outlet means to said housing for directing the flow of waste gases serially through said compartment; and means for rotating said rotary valve means;

the flow entering at least one compartment, passing through said chamber and exiting through at least one other compartment, said rotary valve means rotating and sequentially valving the flow through said compartments.

2. The system of claim 1 wherein said longitudinal axis is vertical; said ends of said housing being its top and bottom, respectively; said chamber being at the top of said housing above said partition means; said plates extending vertically; and said rotary valve means being in the bottom of said housing.

3. The system of claim 1, wherein said partition means comprises radially extending plates dividing said housing into a plurality of sector shaped compartments.

4. The system of claim 2, wherein said partition means comprises radially extending plates dividing said housing into a plurality of sector shaped compartments.

5. The system of claim 1, wherein said means for discharging excess heated gases from said chamber comprises conduit means connected to said chamber and valve means in said conduit means, said valve means being operatively associated with said temperature sensing means.

6. The system of claim 1, wherein said housing is lined with an insulating material.

7. The system of claim 1 further comprising a chamotte refractory-layer interposed between said partition means and said chamber.

8. The system of claim 1 further comprising a guide chamber in said housing interposed between said partition means and said rotary valve means, said guide chamber being divided into halves by said rotary valve means.

* * * * *